US009181503B2

(12) United States Patent
Seiler

(10) Patent No.: US 9,181,503 B2
(45) Date of Patent: Nov. 10, 2015

(54) METHOD FOR THE HEAT TREATMENT OF MATERIAL IN A REACTOR HAVING A WALL ACTING AS SELF-CRUCIBLE

(75) Inventor: Jean-Marie Seiler, Seyssins (FR)

(73) Assignee: Commissariat à l'énergie atomique et aux ènergies alternatives, Paris (FR)

( * ) Notice: Subject to any disclaimer, the term of this patent is extended or adjusted under 35 U.S.C. 154(b) by 958 days.

(21) Appl. No.: 13/382,223

(22) PCT Filed: Jul. 8, 2010

(86) PCT No.: PCT/EP2010/059779
§ 371 (c)(1),
(2), (4) Date: Jan. 4, 2012

(87) PCT Pub. No.: WO2011/003966
PCT Pub. Date: Jan. 13, 2011

(65) Prior Publication Data

US 2012/0097516 A1 Apr. 26, 2012

(30) Foreign Application Priority Data

Jul. 10, 2009 (FR) ..... 09 03425

(51) Int. Cl.
*C10J 3/48* (2006.01)
*C10J 3/74* (2006.01)
(Continued)

(52) U.S. Cl.
CPC .. *C10J 3/74* (2013.01); *C10J 3/485* (2013.01); *C10J 3/723* (2013.01); *C10J 3/84* (2013.01);
(Continued)

(58) Field of Classification Search
CPC ..... C10J 3/466; C10J 3/485; C10J 3/506; C10J 3/52; C10J 3/526; C10J 3/723; C10J 3/84; C10J 2300/09; C10J 2300/0916; C10J 2300/0943; C10J 2300/0983; C10B 57/04; C10B 57/16
USPC ..... 110/229, 342, 343
See application file for complete search history.

(56) References Cited

U.S. PATENT DOCUMENTS 4,439,210 A 3/1984 Lancet
4,680,035 A 7/1987 Tanca
(Continued)

FOREIGN PATENT DOCUMENTS

CA 2 279 821 A1 2/2001
DE 32 19 190 A1 11/1983
(Continued)

OTHER PUBLICATIONS

Jak, E. Saulov, D. Kondratiev, A. Hayes, P. "Prediction of Phase Equilibria and Viscosity in Complex Coal Ash Slag Systems". Fuel Division, 227th ACS National Meeting. Mar. 28-Apr. 1, 2004; Anaheim, CA. Publ. American Chemical Society; 2004, 49(1), 162.*
(Continued)

*Primary Examiner* — Nina Bhat
*Assistant Examiner* — Elizabeth Cardin
(74) *Attorney, Agent, or Firm* — Oblon, McClelland, Maier & Neustadt, L.L.P.

(57) ABSTRACT

A method of thermal treatment of material in a reactor with a high-temperature chamber and with a self-crucible wall, including at least determining liquidus temperature $T_{liq}$ of ashes derived from the treated material, wherein the operating temperature of the reactor $T_{fonc}$ in its steady state is then chosen such that $T_{fonc}>T_{liq}$.

12 Claims, 2 Drawing Sheets

Figure 1:
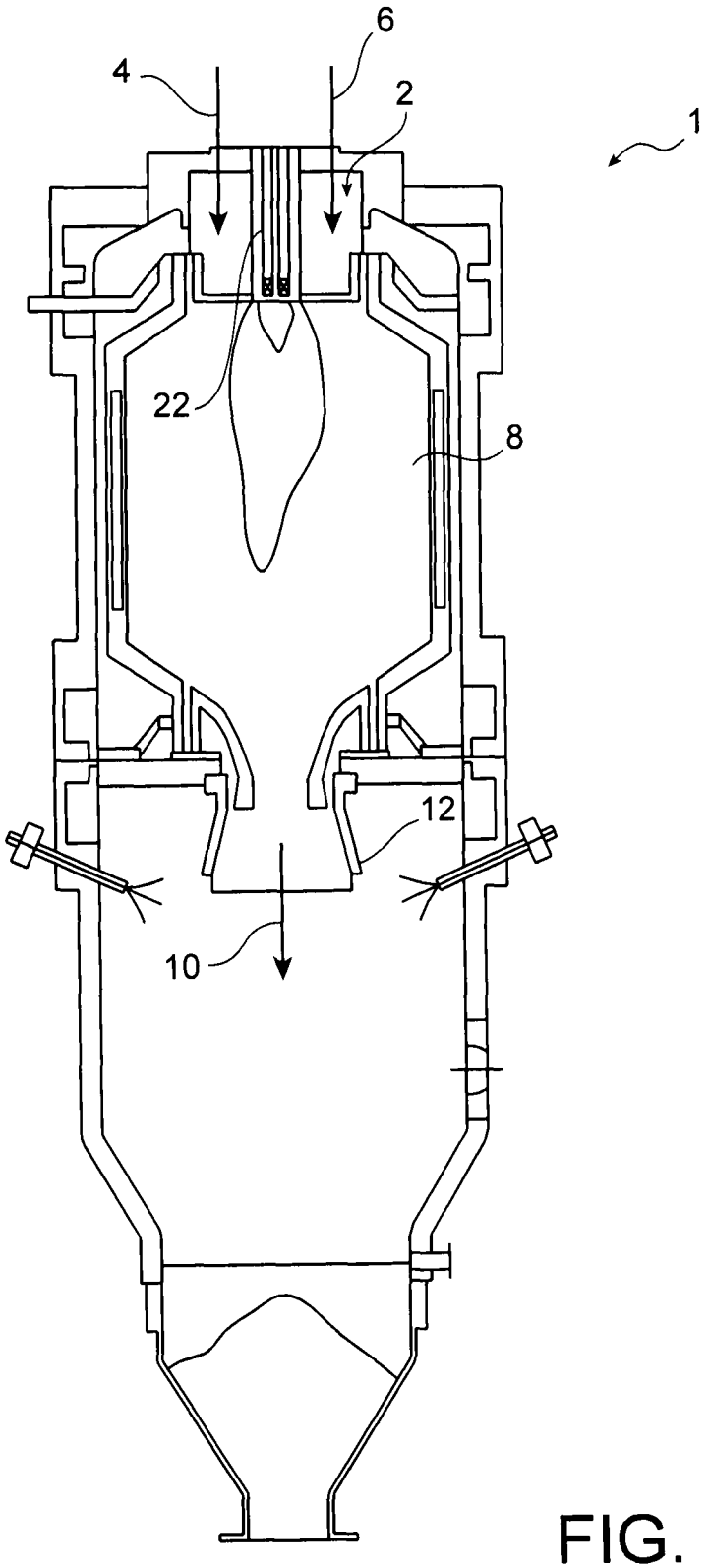

(51) Int. Cl.
*C10J 3/72* (2006.01)
*C10J 3/84* (2006.01)

(52) U.S. Cl.
CPC .... *C10J 2200/152* (2013.01); *C10J 2300/0903* (2013.01); *C10J 2300/0916* (2013.01); *C10J 2300/0959* (2013.01); *C10J 2300/0983* (2013.01); *C10J 2300/1634* (2013.01); *C10J 2300/1846* (2013.01)

(56) References Cited

U.S. PATENT DOCUMENTS

| | | | | |
|---|---|---|---|---|
| 5,620,487 | A | 4/1997 | Andrus, Jr. | |
| 5,968,212 | A | 10/1999 | Peise et al. | |
| 6,484,651 | B1 * | 11/2002 | Shepard et al. | 110/342 |
| 2001/0020346 | A1 * | 9/2001 | Schingnitz et al. | 48/127.9 |
| 2005/0108940 | A1 | 5/2005 | Schingnitz et al. | |
| 2006/0210457 | A1 | 9/2006 | Sprouse et al. | |
| 2008/0134581 | A1 | 6/2008 | Van Dyk et al. | |
| 2010/0065781 | A1 | 3/2010 | Brothier | |

FOREIGN PATENT DOCUMENTS

| | | | |
|---|---|---|---|
| DE | 44 46 803 | A1 | 6/1996 |
| EP | 0066563 | A2 * | 12/1982 |
| EP | 0 076 092 | A1 | 4/1983 |
| WO | WO 95/13339 | | 5/1995 |
| WO | WO 2006/082543 | A1 | 8/2006 |

OTHER PUBLICATIONS

International Search Report issued Dec. 28, 2010, in PCT/EP2010/059779.

International Preliminary Report on Patentability issued Jan. 19, 2012, in PCT/EP2010/059779 (with English-language translation).

J. Poirier, "Projet Inorganiques", Programme National De Recherche Sur Les Bioenergies (PNRB), Presentation at the Scientific Forum, XP 002572527, Feb. 26, 2008, 25 pages.

J. C. van Dyk, et al., "Manipulation of gasification coal feed in order to increase the ash fusion temperature of the coal enabling the gasifiers to operate at higher temperatures", Fuel, vol. 86, No. 17-18, XP 022322099, Oct. 30, 2007, pp. 2728-2735.

Jérôme Berjonneau, et al., "Determination of the Liquidus Temperatures of Ashes from the Biomass Gazification for Fuel Production by Thermodynamical and Experimental Approaches", Energy & Fuels, vol. 23, XP 002572528, Oct. 28, 2009, pp. 6231-6241.

Evgueni Jak, "Prediction of coal ash fusion temperatures with the F* A* C* T thermodynamic computer package", Fuel, vol. 81, No. 13, XP 004371793, Aug. 1, 2002, pp. 1655-1668.

Preliminary Search Report issued Mar. 10, 2010 in French Patent Application No. 0903425 with English translation of categories of cited documents.

* cited by examiner

METHOD FOR THE HEAT TREATMENT OF MATERIAL IN A REACTOR HAVING A WALL ACTING AS SELF-CRUCIBLE

TECHNICAL FIELD

The invention concerns the field of the heat treatment of material in a reactor having a wall acting as a self-crucible, or cold crucible, such as an entrained flow reactor.

The invention applies in particular for gasification of biomass, whether or not pretreated, in an entrained flow reactor which is allothermal (i.e. using an energy external to the system constituted by the treated material to undertake the gaseous conversion) or autothermal (not requiring any energy external to the system to undertake the gaseous conversion). The invention may generally be used to accomplish all types of gasification of material, for example coal, refining sludges or all types of liquid and/or solid waste comprising organic and inorganic elements, with a view to generating electricity or producing biofuels.

The invention also applies for undertaking thermal treatments of material in other reactors of the allothermal type, for example in plasma reactors or in reactors in which a combustible gas is added (hydrogen or methane, for example).

The invention also concerns the thermal treatment of material in all types of industrial fusion reactor, for example an asbestos fusion reactor, in order to accomplish a vitrification of the asbestos.

STATE OF THE PRIOR ART

Gasification of biomass has been developed essentially for applications of the cogeneration type, i.e. those enabling biomass to be treated and transformed into thermal energy and electricity. A known technique to accomplish such gasification consists in bringing fine biomass particles into contact with oxygen at high temperature in an entrained flow reactor, as for example described in documents U.S. Pat. No. 5,620,487 and U.S. Pat. No. 4,680,035. Documents U.S. Pat. No. 5,968,212 and DE 4 446 803 describe techniques which enable dual-constituent refractory zones and cooled zones to be managed to take the thermal stresses into account.

An example of an entrained flow reactor 1 is represented schematically in FIG. 1. The reactor 1 includes an inlet 2 through which the material to be treated 4, for example biomass, and reactant gases 6 such as oxygen and/or methane, are introduced. The reactor 1 includes a high-temperature chamber 8 (with a temperature, for example, of between approximately 1000° C. and 1800° C.) in which reactions to convert the biomass 4 into synthetic gases 10 occur, which gases are obtained in the area of an outlet 12 of the high-temperature chamber 8. The time taken to convert the biomass 4 into synthetic gases 10, which is the time during which the biomass 4 remains in the high-temperature chamber 8, is of the order of a few seconds. The reactor 1 also includes a burner 22 enabling the desired temperature to be obtained in the chamber 8.

As indicated in the document by C. Dupont et al., "Suitability of biomass feedstocks for use in a semi-industrial plant of BtL production by gasification", 2008, 16$^{th}$ European Biomass Conference & Exhibition, Valencia, biomass includes organic compounds which may be represented in the form $C_6H_{9\pm1}O_{4\pm0.5}$ (elementary representation) enabling synthetic gases such as CO, $H_2$, $CO_2$, $H_2O$ or again $CH_4$ to be obtained. The biomass also includes inorganic compounds formed by all the other elements contained in the biomass (principally oxides such as CaO, $SiO_2$, $Al_2O_3$, FeO or again MgO), which may not be transformed into synthetic gases. In the course of the operation to gasify the biomass these compounds are transformed into ashes.

The inorganic compounds are non-recyclable elements for the transformation of the biomass into fuel (where the fuel is obtained by recombining the CO and $H_2$ gases to obtain $CH_4$), and they cause operational problems for the treatment installations, and environmental problems, and which require, in the case of certain mineral elements, re-spreading on the land. Between approximately 0.5% and 3% by mass of the biomass has the form of ashes when a biomass gasification operation is undertaken in an entrained flow reactor.

The high temperature reached in the chamber 8 of the entrained flow reactor 1 allows, simultaneously:

- a gas rich in CO and $H_2$ to be obtained,
- methane to be re-formed from CO and $H_2$,
- tars to be reformed (enabling tar concentrations of less than approximately 1 mg/Nm$^3$ to be obtained),
- the ashes which flow along the walls of the high-temperature chamber 8 to be melted.

The reactor 1 can operate in a pressurised atmosphere, for example as high as approximately 80 bars. Pressure resistance is provided by a cold wall surrounding the reactor's high-temperature chamber 8. The wall of the chamber 8 must also be able to resist the high temperature. Compared to other gasification systems, for example fluidized bed reactors operating at temperatures of below approximately 1000° C., an entrained flow reactor can therefore operate under severe temperature and pressure conditions.

While the reactor 1 is in operation the particles of biomass will be pyrolysed very rapidly, releasing partially oxidised vapours, due to the oxygen present in the chamber 8. By this means a reaction providing the heat required for gasification of the biomass coal and for heating the blend is obtained. The residual ashes will melt and be deposited principally on the wall 8 where they will flow. These residual ashes will form a layer of liquid ashes, or molten ashes, and a layer of solid ashes acting as a thermal insulator between the layer of liquid ashes and the wall of the chamber 8, also called the reactor wall, according to the operating principle of a self-crucible reactor, and forming a wall called a self-crucible wall.

Indeed, in the entrained flow reactor 1 operating as a self-crucible, the wall of the high-temperature chamber 8 is insulated from the molten ashes by a layer of solid ashes of thickness for example of between approximately 1 mm and a few centimeters, for example less than or equal to approximately 5 cm. This layer of solid ashes is formed spontaneously on contact with the walls of the chamber which are cooled by a water circulation system.

Figure 3:
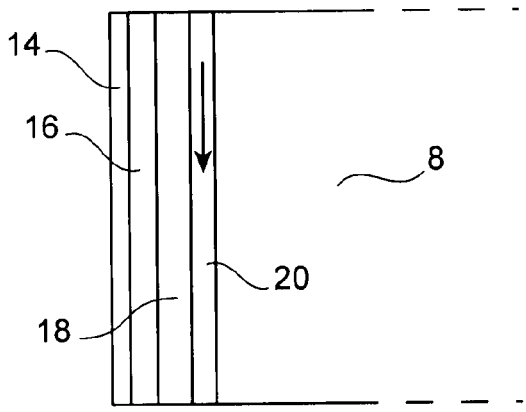

FIG. 3 represents the different elements forming the "multi-layer" wall of the high-temperature chamber 8. Such a multi-layer wall is, for example, described in document US 2005/0108940 A1.

The external layer of the wall includes a forced-convection cooling circuit 14. This circuit 14 includes tubes through which the pressurised water flows. These tubes are fitted with fins enabling, firstly, satisfactory mechanical attachment to be obtained to an intermediate layer 16, and secondly a heat flow collector to be formed to collect heat originating from inside the chamber 8, and direct it towards the tubes of the cooling circuit 14. This external layer is also designed to withstand the pressure present in the chamber 8 whilst the reactor 1 is in operation.

The multi-layer wall also includes the intermediate layer 16 which is between approximately 1 cm and 2 cm thick, and of a refractory ceramic type, for example made from silicon carbide (SiC). This intermediate layer 16 has satisfactory thermal conductivity, thus enabling the heat flow to be distributed satisfactorily between a third layer 18 of solidified ashes and the cooling circuit 14. This intermediate layer 16 also enables the thermal shocks to be absorbed in the event that a portion of the layer of solid ashes 18 is lost when the reactor 1 is in operation.

Finally, the multi-layer wall includes the layer of solidified ashes 18 supported by the intermediate layer 16. This layer 18 acts as a thermal screen and is made from a material (solid ashes) of the same kind as that of molten ashes 20 flowing over the inner surface of the wall, against this layer of solid ashes 18 (this flow is represented by an arrow in FIG. 3).

Thus, when the reactor is operating as a self-crucible a portion of the ashes contained in the hydrocarbon load of the biomass is solidified and forms a refractory material. The other portion of the ashes are in liquid form and are recovered in the lower part of the reactor (outlet 12), and immersed in water.

The inorganic elements present in the material to be treated which is found in the ashes pose many problems, and notably that of the corrosion of the reactor wall by the liquid ashes. Indeed, the liquid ashes may destroy a refractory ceramic through physico-chemical interaction (for example through a dissolution phenomenon), even when these liquid ashes are at a temperature well below the melting point of the refractory ceramic.

Thus, in an entrained flow reactor, if the reactor's operating temperature is too low, solid ashes are accumulated on the wall, and this may result in the destruction of the wall. If the reactor's operating temperature is too high, the thermal losses are then too great, and the liquid ashes attack the wall, which may lead to a breach of the reactor wall.

Figure 2:
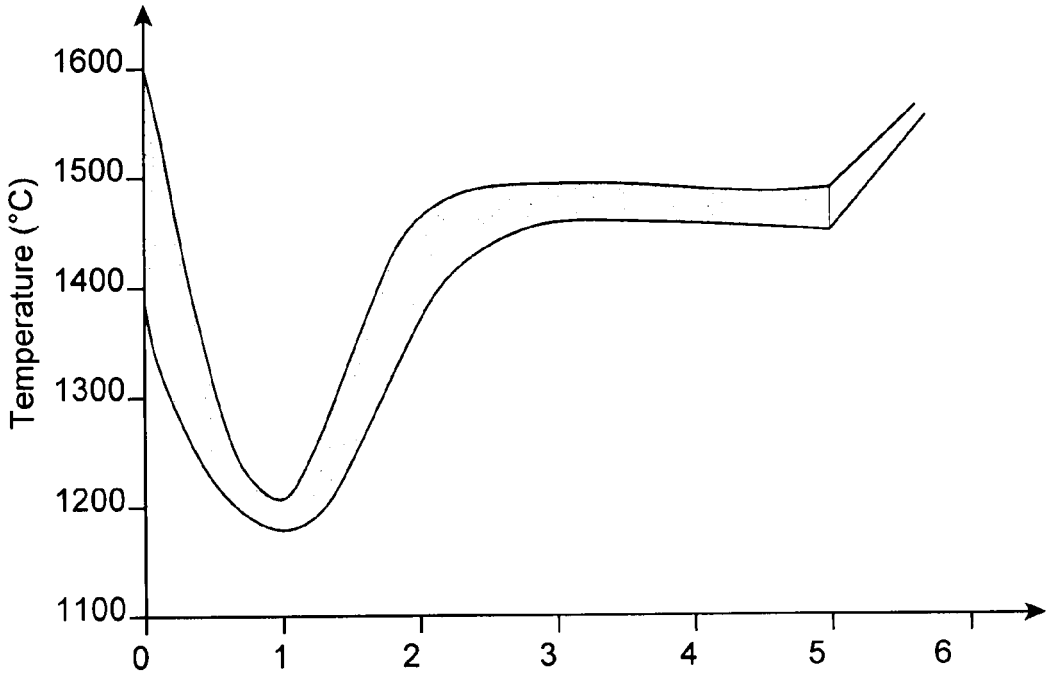

Entrained flow reactors are currently operated using an empirical approach, on the basis of data supplying the reactor's operating characteristics in accordance with the known compositions of the material to be treated. FIG. 2 represents a graph giving the reactor's operating temperature as a function of the value of a ratio of concentrations of elements present in the material to be treated. The values of the abscissa axis are those of the following concentration ratio:

$$\frac{CaO + MgO + Fe_2O_3 + Na_2O + K_2O}{SiO_2 + Al_2O_3 + TiO_2}$$

It is therefore currently possible to gasify only material the chemical composition of which is known in advance, situated within a limited interval, and for which corresponding reactor operating temperatures are also known not to damage the reactor. A resource the ash composition of which does not match a predetermined composition cannot therefore be gasified in an entrained flow reactor without risking damage to the reactor.

Thus, in current reactors, the wall must be changed regularly, more or less frequently, which represents a major disadvantage (substantial maintenance costs and reactor shutdown costs).

ACCOUNT OF THE INVENTION

One aim of the present invention is to propose a method of operation, or management, or use, which is deterministic and not empirical, of a reactor of the self-crucible type, and also a method of thermal treatment of material in a reactor with a high-temperature chamber and with a self-crucible wall, which can be implemented for all types of resources, or of raw materials, even those the corresponding reactor operating temperatures of which are not known, and to do so without damaging the reactor.

To accomplish this, the present invention proposes a method of thermal treatment of material in a reactor with a high-temperature chamber and with a self-crucible wall including at least one step of determination of the liquidus temperature $T_{liq}$ of the ashes derived from the treated material, where the operating temperature of the reactor $T_{fonc}$ in its steady state is then chosen such that $T_{fonc} > T_{liq}$.

The operating temperature $T_{fonc}$ of the reactor designates here, and in the remainder of the document, the temperature found at the outlet of the reactor's high-temperature chamber, i.e. the temperature of the gas present at the outlet of the high-temperature chamber.

The liquidus temperature of a blend is the temperature above which all the constituents of the blend become liquid.

Such a method enables the problems relating to inorganic elements present in the treated material to be resolved through optimum operation of the reactor, obtained by a choice of optimum operating temperature of the reactor in accordance with the nature of the treated material. The method according to the invention therefore allows an optimum thermo-chemical conversion of the material to be treated, and more specifically an optimum thermo-chemical conversion of the inorganic elements present in this material, whatever the nature of the material to be treated.

According to the invention, the reactor's operating temperature is adjusted relative to the chemical properties of the ashes, i.e. relative to the composition of the ashes of the material to be treated, in a deterministic manner, using the key parameter represented by the liquidus temperature $T_{liq}$ of the ashes derived from the treated material. The method according to the invention therefore enables material to be treated thermally even if it has never previously been treated. Thus, in the case of material of which it is said that it may not be treated in a reactor, for example an entrained flow reactor (which is the case for material the melting point of the ashes of which is too low or too high compared to the reactor's empirical operating data), the invention enables the characteristics of the ashes to be modified deterministically, in order to make treatment of them compatible with the reactor's operating constraints. In addition, this method enables operation to be obtained with the reactor in thermodynamic equilibrium, allowing perfect prediction of the composition of the synthetic gas and cracking of the methane and the tars.

The reactor's operating temperature can also be controlled in accordance with the chemical gasification reactions occurring in the reactor during thermal treatment of the material, i.e. in accordance with the changes in the composition of the ashes derived from the treated material. It is therefore possible, firstly, to cause the reactor to operate at a minimum temperature maximising conversion to CO and $H_2$, and secondly to prevent the reactor from operating at excessive temperatures which would increase the thermal losses. The minimum temperature can therefore depend on the material to be treated, the reactor's operating pressure and the time during which the material remains in the reactor.

In addition, due to the optimum operation of the reactor obtained, the method according to the invention also allows:

- thermal losses in the wall of the reactor's high-temperature chamber to be limited (thermal losses less than, for example, approximately 100 $kW/m^2$),
- the weight of the layer of solid ashes to be limited; the method according to the invention notably enables an uncontrolled increase of the thickness of the layer of solid ashes to be prevented (a thickness obtained of the order of a few centimeters, and roughly constant during operation at the reactor's steady state), a wall to be formed which is resistant to the thermal shocks which could be related to reactor operating incidents, such as for example loss of a part (plate) of the layer of solid ashes.

The invention also concerns a method of thermal treatment of material in a reactor with a high-temperature chamber and a self-crucible wall, including at least the steps of:

a) choice of a range of reactor operating temperatures [$T_1$; $T_2$] enabling the thermal treatment of the material to be accomplished, b) determination of the liquidus temperature $T_{liq}$ of the ashes derived from the material to be treated; and, subsequently:

if $T_1<T_{liq}<T_2$: determination of the reactor's operating temperature $T_{fonc}$ at steady state such that $T_{fonc}>T_{liq}$ and $T_{fonc}\in[T_1; T_2]$ if $T_{liq}\geq T_2$: modification of the initial composition of the material through quantified addition of fluxing inorganic compounds, i.e. compounds enabling the liquidus temperature of the initial composition to be reduced, such that the liquidus temperature $T_{liq2}$ of the ashes of the modified composition of the material is less than $T_2$, followed by determination of the reactor's operating temperature $T_{fonc}$ in the steady state such that $T_{fonc}>T_{liq2}$ and $T_{fonc}\in[T_1; T_2]$, if $T_{liq}\leq T_1$: modification of the initial composition of the material through the quantified addition of refractory inorganic compounds such that the liquidus temperature $T_{liq2}$ of the ashes of the modified composition of the material is higher than $T_1$, followed by determination of the reactor's operating temperature $T_{fonc}$ in the steady state such that $T_{fonc}>T_{liq2}$ and $T_{fonc}\in[T_1; T_2]$.

The method may also include the following steps:

modification of the initial composition of the treated material through addition(s) of inorganic compounds, followed by determination of the liquidus temperature $T_{liq2}$ of the ashes derived from the modified composition of the thermally treated material, where the reactor's operating temperature $T_{fonc}$ in the steady state may be chosen such that $T_{fonc}>T_{liq2}$.

After determination of the liquidus temperature $T_{liq2}$ of the ashes derived from the modified composition of the thermally treated material, it is possible to check that $T_{liq2}<T_2$ in order to satisfy the condition $T_1<T_{liq2}<T_2$.

Thus, when the initial composition of the material has a liquidus temperature of the ashes derived from this material which is incompatible or non-optimal for the choice of the reactor's operating temperature, the invention proposes a quantifiable method therefore enabling this initial composition to be modified in order that the ashes derived from the modified composition may have a liquidus temperature which is compatible with and optimal for operation of the reactor.

Advantageously, $T_{fonc}$ may be chosen such that 30° C.≤($T_{fonc}-T_{liq}$)≤100° C. and/or 30° C.≤($T_{fonc}-T_{liq2}$)≤100° C. Given that the thermal losses in the reactor and the thickness of the layer of solid ashes formed on the reactor wall notably depend on the difference between the reactor's operating temperature and the liquidus temperature of the ashes derived from the material to be treated, it is therefore possible to reduce the thermal losses in the reactor, which may be less than approximately 100 kW/m$^2$, by making the reactor's operating temperature in the steady state close to the liquidus temperature of the ashes derived from the treated material (difference less than or equal to approximately 100° C.).

In addition, it is possible to monitor the changes in the reactor's operating temperature through a measurement of the thermal losses (for example by implementing a heat balance in relation to the cooling of the walls of the reactor), on the basis of a constant ashes composition.

Advantageously, in order to accomplish a gasification of biomass, the initial composition of the treated material can be modified such that the liquidus temperature $T_{liq2}$ of the ashes derived from the modified composition of the treated material may be between approximately 1200° C. and 1800° C., for example between approximately 1400° C. and 1600° C., or between approximately 1300° C. and 1500° C., or between approximately 1300° C. and 1600° C., or between approximately 1450° C. and 1550° C. The choice will preferably be made to modify the initial composition of the treated material such that the liquidus temperature $T_{liq2}$ of the ashes derived from the modified composition of the treated material may be between approximately 1400° C. and 1600° C. However, it is possible to reduce this temperature range by a value of between approximately 100° C. and 200° C. when the time during which the treated material remains in the reactor is increased, which enables the energy efficiency of the method to be improved. If it is desired to transform a particularly difficult resource, such as refining sludges, this temperature range ([1400° C.; 1600° C.]) may be increased by a value of between approximately 100° C. and 200° C.

Modification of the initial composition of the treated material such that the liquidus temperature $T_{liq2}$ of the ashes of the modified composition of the treated material is between approximately 1400° C. and 1600° C., or between approximately 1300° C. and 1500° C., or between approximately 1300° C. and 1600° C., or between approximately 1450° C. and 1550° C., can include at least one step of addition of inorganic compounds to the initial composition of the treated material able to make the $SiO_2$ and CaO concentrations in the modified composition of the treated material roughly equal.

The initial composition of the treated material may be modified by at least one step of addition of MgO and/or of $Fe_2O_3$ and/or of $K_2O$ and/or of $Na_2O$ and/or of $P_2O_5$ and/or of CaO and/or of $SiO_2$, depending on the desired liquidus temperature $T_{liq2}$ of the ashes derived from the modified composition of the treated material.

Advantageously, additions of fluxing agents (compounds of the $K_2O$, $Na_2O$, $Fe_2O_3$, MgO or $P_2O_5$ type) to the treated material can cause a reduction of the liquidus temperature of the ashes derived from the treated material of between approximately 50° C. and 200° C.

By increasing the $SiO_2$ and/or CaO concentrations in the composition of the treated material, it is possible to increase the liquidus temperature of the ashes derived from the modified composition of the treated material.

The thickness of the layer of solid ashes of the self-crucible wall of the reactor may be less than or equal to approximately 5 cm, or between approximately 1 cm and 2 cm, and/or be roughly constant during operation of the reactor at its operating temperature $T_{fonc}$.

The reactor's operating temperature $T_{fonc}$ may be between approximately 1000° C. and 1800° C., and for example between approximately 1400° C. and 1600° C. for a biomass treatment.

The composition of the ashes formed on the reactor wall may be analysed at least once, and preferably several times, during the thermal treatment process, for a given resource.

It is thus possible to modify the reactor's operating temperature according to the elements present in the material treated in the reactor.

The reactor with a self-crucible wall may be of the entrained flow type and/or the treated material may be biomass. The method can be implemented preferably for large-capacity reactors, i.e. reactors in which the flow rate of treated material can be greater than or equal to approximately 50 tonnes/hour.

The method may use a system for rapid measurement of the inorganic compound and ashes content of the treated material, and a system for automatic adjustment of the composition of treated material according to the desired operating temperature of the reactor.

The liquidus temperature of the ashes derived from the treated material may be determined by a thermodynamic computation software.

BRIEF DESCRIPTION OF THE ILLUSTRATIONS

The present invention will be better understood on reading the description of example embodiments given purely as an indication and in no way restrictively, making reference to the appended illustrations in which:

FIG. 1 represents schematically an entrained flow reactor used in the course of a method of thermal treatment of material, forming the subject of the present invention, FIG. 2 represents a graph enabling the operating temperature of an entrained flow reactor to be determined empirically according to the composition of the treated material, FIG. 3 represents schematically a self-crucible wall of a high-temperature chamber of an entrained flow reactor used in the course of a method of thermal treatment of material, forming the subject of the present invention, Identical, similar or equivalent portions of the various figures described below have the same numerical references, to make it easier to move from one figure to another.

The various parts represented in the figures are not necessarily represented at a uniform scale, in order to make the figures more readable.

The various possibilities (variants and embodiments) must be understood as not being mutually exclusive, and being able to be combined with one another.

DETAILED ACCOUNT OF PARTICULAR EMBODIMENTS

As has been previously described in connection with FIG. 3, an entrained flow reactor 1 includes a high-temperature chamber 8 including a "multi-layer" wall (layers 14, 16, 18 and 20) which is formed whilst the reactor 1 operates as a self-crucible.

In order better to understand the different conditions required by the method of thermal treatment of material according to the invention, a thermodynamic modelling of the multi-layer wall of the entrained flow reactor 1 is described below.

Firstly, the different contact temperatures between the layers 14, 16, 18 and 20 of the wall applied during operation of the reactor 1 are:

- $T_{fonc}$ the operating temperature of the reactor 1, i.e. the temperature of the gas present at the outlet of the high-temperature chamber 8 of the reactor 1,
- $Ti_{g/s}$: the interface temperature between the gas and the liquid ashes layer 20,
- $Ti_{s/solid}$: the interface temperature between the liquid ashes layer 20 and the solid ashes layer 18,
- $Ti_{liner/solid}$: the interface temperature between the solid ashes layer 18 and the intermediate layer 16 made from a refractory material, in this case SiC,
- $Ti_{liner/water}$: the interface temperature between the intermediate layer 16 and the cooling circuit 14.

When the reactor is operating in a steady state, i.e. when all the operating parameters are constant over time (power, biomass flow rate, etc.), the solid ashes layer 18 is then formed against the intermediate layer 16 and the heat flow $\phi$ which crosses the different layers 20, 18, 16 and 14 of the wall is constant.

In the solid layers (layers 14, 16 and 18), distribution of the temperatures is controlled by the conductive heat transfers through these layers. The thickness of the different layers is presumed to be small compared to the reactor's diameter. It is then possible to write:

$$\varphi = \lambda_{liner}\frac{Ti_{solid/liner} - Ti_{liner/water}}{e_{liner}} = \lambda_{solidash}\frac{Ti_{s/solid} - Ti_{solid/liner}}{e_{solidash}} \quad (1)$$

where:

$\lambda_{liner}$: thermal conductivity of the intermediate layer 16, $\lambda_{solidash}$: thermal conductivity of the solid ashes layer 18, $e_{liner}$: thickness of the intermediate layer 16, $e_{solidash}$: thickness of the solid ashes layer 18.

The thickness of the intermediate layer 16 is known. Consequently, the difference in temperatures over the thickness of the intermediate layer 16 may be determined by:

$$Ti_{solid/liner} - Ti_{liner/water} = \frac{\varphi \cdot e_{liner}}{\lambda_{liner}} \quad (2)$$

$Ti_{liner/water}$ is close to the temperature of the water flowing in the cooling circuit 14 (for example approximately 100° C.). By taking a reference heat flow, for example equal to approximately 100 kW/m$^2$ if it is desired not to exceed this level of thermal losses, with a characteristic thermal conductivity of the intermediate layer 16 of between approximately 5 W/m·K and 10 W/m·K, and a thickness of the intermediate layer 16 equal to approximately 1 cm, a temperature difference of between approximately 100° C. and 200° C. is then obtained. This temperature difference therefore remains small compared to the difference between the temperature of the gas (for example between approximately 1400° C. and 1600° C.) and that of the cooling water (equal to approximately 100° C.).

If a characteristic thermal conductivity of 1 W/m·K is now supposed for the solid ashes layer 18 and a temperature of the liquid ashes 20 close to the temperature of the gas, a thickness of the solid ashes layer 18 of between approximately 1 and 2 cm, and, for example, equal to 1.5 cm, may be deduced.

The interface temperature between the solid ashes layer and the liquid ashes layer ($Ti_{s/solid}$) is derived from metallurgical "steady state" considerations. Steady state operation of the reactor means that the flow rates, compositions and temperature distributions are constant and do not vary over time. This means, in particular, that the flow of the liquid ashes 20 is constant, and that the solid ashes layer 18 is constant, and that its thickness no longer varies.

During steady state operation of the reactor there is therefore no solidification or dissolution of ashes at the interface between the solid ashes layer 18 and the liquid ashes layer 20 (no mass transfer at this interface). The speed of solidification of the ashes is therefore zero. And a zero solidification speed in metallurgy enables it to be deduced that the interface temperature between the liquid ashes layer and the solid ashes layer is equal, for a non-eutectic system, as is the case here, to the liquidus temperature $T_{liqu}$ of the ash in question:

$$Ti_{s/solid}=T_{liqu} \quad (3)$$

Thus, the interface temperature between the liquid ashes layer and the solid ashes layer is therefore an intrinsic property of the ash, thus making the temperature present in the high-temperature chamber independent of the temperature within the wall.

Given that the temperature in the liquid ashes layer 20 is higher than $Ti_{s/solid}$, the ashes flowing along the wall of the high-temperature chamber, i.e. the ashes present in the layer 20, are completely liquid (no solids).

In the entrained flow reactor 1 described here, the thickness of the liquid ashes layer 20 varies between approximately 0.5 mm and 2.5 mm for a reference viscosity equal to approximately 1 Pa·s. In addition, the average flow speed of the liquid ashes varies between approximately 2 mm/s and 20 mm/s.

Consequently, the Reynolds number remains very low, for example equal to approximately $10^{-5}$, which confirms the state of laminar flow of the liquid ashes 20.

If the viscosity is increased by a factor of 1000 the thickness of the liquid ashes layer increases by a factor of between approximately 4 and 10; simultaneously, the average flow speed is reduced by the same factor. The thermal conduction resistance associated with the liquid ashes layer varies in this case between approximately $5.10^{-4}$ and $2.10^{-3}$ $K \cdot W^{-1} \cdot m^2$. This means that, for an average heat flow equal to approximately 100 $kW/m^2$, the temperature difference over the thickness of the liquid ashes layer is of the order of 50° C. to 200° C. Incorporation of radiation enables this temperature difference to be reduced by a factor of between approximately 1.5 and 3. The temperature difference over the thickness of the liquid ashes layer then falls by between approximately 30° C. and 70° C.

The liquidus temperature of the ash is an intrinsic property of the ash. The basic components of an ash are oxides, among which silica ($SiO_2$) and calcium oxide (CaO) are present in the greatest quantities. These species therefore form the reference system for the analysis of changes of the liquidus temperature $T_{liqu}$ of the ashes according to the composition of these ashes.

For example, for an ash composition including approximately 2 kg of CaO and 1 kg of FeO, the variation of $T_{liqu}$ as a function of the quantity of $SiO_2$ is such that:

| Mass of $SiO_2$ (kg) | $T_{liqu}$ |
|---|---|
| 1 | 1800 |
| 1.5 | 1690 |
| 2 | 1610 |
| 3 | 1620 |
| 4 | 1830 |

The addition of oxides with low melting points, such as for example $K_2O$, or $Na_2O$, which are present in significant quantities in biomass ashes (up to 20% by weight), may reduce $T_{liqu}$ by nearly 200° C.

In addition, it can also be seen that, when added, $SiO_2$ (respectively CaO) can act either as a fluxing agent (reducing $T_{liqu}$) or as a refractory (increasing $T_{liqu}$), depending on the initial Cao concentration (respectively $SiO_2$ concentration).

The liquidus temperature of an ash can therefore vary between approximately 1150° C. and as high as 1600° C. depending on the composition of the ash, or even, in the case of an ash which is very rich in calcium oxide, as high as a temperature greater than approximately 2000° C.

Bearing in mind that which was stated above, the reactor's operating temperature is therefore chosen to be higher than the liquidus temperature of the ashes derived from the treated material.

The thermal losses are then given by the following equation:

$$\phi=h_{gas}(T_{fonc}-Ti_{g/s}) \quad (5)$$

Where $h_{gas}$: thermal exchange coefficient relating to the flow of gas in the high-temperature chamber.

$Ti_{g/s}$ is equal to $T_{liqu}+\Delta T_{slag}$, where $\Delta T_{slag}$ is the temperature difference over the thickness of the liquid ashes layer. And $\Delta T_{slag}$ is small in comparison with $T_{liqu}$. $T_{liqu}$ is consequently a satisfactory approximation of $Ti_{g/s}$. $h_{gas}$ is directly related to the flow of the gas and to the thermal radiation. It can therefore be seen that the thermal losses are directly proportional to the difference $T_{fonc}-T_{liqu}$.

The thermal losses can thus be reduced if the reactor's operating temperature is brought close to the liquidus temperature of the ash. Therefore, in addition to operating the reactor at a temperature higher than the liquidus temperature of the ashes, the reactor's operating temperature may be chosen to be higher, by approximately 50° C. to 100° C., than $T_{liqu}$. $T_{fonc}$ will preferably be chosen such that the following applies approximately: 50° C.$\leq(T_{fonc}-T_{liq})\leq$100° C.

Temperature difference $T_{fonc}-T_{liqu}$ controls both the thermal losses and the thickness of the solid ashes layer of the reactor wall. By taking 10 $kW/m^2 \cdot K$ as a typical exchange coefficient for the gas (in the high-temperature chamber) and a temperature difference $T_{fonc}-T_{liqu}$ of approximately 100° C., thermal losses of the order of approximately 100 $kW/m^2$ and a solid ash thickness of approximately 1 cm are found. These thermal losses amount to less than a 1% loss of power for an entrained flow reactor operating at 50 bars and processing at a flow rate of approximately 50 tonnes/hour of biomass.

The composition of the ashes will preferably be monitored during the process in order to ensure that the liquidus temperature does not vary by more than approximately 50° C. Maintenance of this temperature interval thus amounts to maintaining the adequate interval of composition of ashes.

If the initial composition of the treated material has a liquidus temperature of the ashes derived from this material which does not enable an optimum operating temperature to be chosen, for example when this liquidus temperature is too high, it is possible to adjust the composition of the material by modifying it in order to modify the liquidus temperature of the ashes derived from the modified composition of material. This modification is, in this case, for example accomplished through continuous addition of fluxing inorganic compounds to the initial composition of treated material, throughout the thermal treatment of this material.

In terms of the method's energy efficiency, it may be advantageous to choose the lowest possible reactor operating temperature, whilst ensuring that it is higher than the liquidus temperature of the ashes derived from the treated material. The reactor's optimum operating temperature may, notably, be chosen to allow the tars and the methane to reform. An operating temperature of less than approximately 1500° C., for example equal to approximately 1250° C., may notably be chosen. If it is desired to operate the reactor at this temperature level, the liquidus temperature of the ashes may then be reduced to approximately 1150° C. if the liquidus temperature of the ashes derived from the initial composition of the treated material is higher than this value.

The liquidus temperature of the ashes may be reduced by incorporating compounds of the $Na_2O$ or $K_2O$ type, or other oxides with low melting points, in the initial composition of the treated material.

Depending on the operating temperature which it is desired to achieve the following operations may be accomplished:

- if it is desired to change the reactor's operating temperature to approximately 1500° C., it is firstly possible to balance the $SiO_2$ and CaO concentrations in the composition of treated material by adding CaO if $SiO_2$ is dominant in the initial composition of material, and vice versa,
- if it is desired to increase the operating temperature above approximately 1500° C., it is possible to increase the $SiO_2$ or CaO concentration in the initial composition of treated material. Addition of $SiO_2$ will also lead to an increased viscosity of the liquid ashes,
- if it is desired to reduce the operating temperature to approximately 150° C. below the initial operating temperature, compounds such as iron oxide or MgO may be added,
- if it is desired to reduce the operating temperature still further, fluxing agents such as $K_2O$, $Na_2O$ or again $B_2O_3$ or $P_2O_5$ may also be added, having regard for the volatility of these constituents in order not to modify the composition of the ashes in an uncontrolled manner.

A modification of the initial composition of treated material, which thereby modifies the composition of the ashes in the reactor, and therefore modifies the liquidus temperature of these ashes, through the addition of compounds, may be accomplished preferably when the initial ash content (i.e. the inorganic compound content) of the treated material is small (for example, in the case of wood).

Throughout the method of thermal treatment of material implemented in the reactor 1, it is possible to measure the thermal losses, by means of a heat balance undertaken on the cooling of the external walls, in order to monitor the changes in the temperature of the gas, where the ash composition remains constant. Thus, it is possible to modify the treated material composition if the reactor's thermal losses deviate too substantially.

Three different example ash compositions C1, C2 and C3, typical of different varieties of biomass, are described below. Since the fundamental constituents of these ashes are $SiO_2$ and CaO, the three typical compositions have variable relative concentrations of these constituents:

- composition C1 is rich in $SiO_2$,
- composition C2 has balanced concentrations of CaO and $SiO_2$,
- composition C3 is rich in CaO.

The compositions of ashes C1, C2 and C3 (as a percentage by weight) are given in detail in the table below.

| | C1 | C2 | C3 |
|---|---|---|---|
| $SiO_2$ | 60 | 34 | 11 |
| $Al_2O_3$ | 5 | 1 | 2 |
| $Fe_2O_3$ | 3 | 5 | 2 |
| CaO | 13 | 34 | 53 |
| MgO | 4 | 3 | 10 |
| $K_2O$ | 14 | 22 | 16 |
| $Na_2O$ | 1 | 1 | 2 |
| $P_2O_5$ | 0 | 0 | 4 |

The liquidus temperatures of these ashes are then calculated by means of thermodynamic computation software, on the basis of their chemical compositions. The table below summarises the results obtained.

| | C1 | C2 | C3 |
|---|---|---|---|
| Liquidus temperature (° C.) | 1324 | 1256 | 2190 |

In the implementation of the method of thermal treatment of material described here, the liquidus temperature of the ashes derived from the treated material is preferably calculated using a thermodynamic computation software for reasons of cost and speed. However, it would also be possible to measure the liquidus temperature of the ashes derived from the treated material by different techniques, such as, for example, those described below. It is also possible that the liquidus temperature of the ashes may be determined by means of a modelling software, the models of which are based on established experimental data for ashes of different compositions. Thus, depending on the composition of the treated material, and possibly of the added inorganic compounds, it is possible to estimate the liquidus temperature of the ashes derived from this composition of treated material, and then to define the furnace's operating temperature.

The liquidus temperature may, for example, be measured by a method of microscopic observations after quenching of a small quantity (for example 40 mg) of ashes in the form of a bead, initially heated to a high temperature in the furnace. According to another method, the liquidus temperature of the ashes may also be measured in place by high-temperature X-ray diffraction. According to another method, the liquidus temperature of the ashes may also be approached by a Differential Thermal Analysis—Thermogravimetric Analysis (ATD-ATG), which is a calorimetric method consisting in monitoring changes in the temperature difference between the sample studied and an inert control body.

Other measuring methods could also be used to measure the liquidus temperature of the ashes of the treated material (measurement by optical pyrometry, etc.).

Bearing in mind the previously calculated liquidus temperatures of the ashes C1, C2 and C3, it can be seen that composition of ashes C3 is not suitable for thermal treatment in an entrained flow reactor the desired operating temperature of which is between approximately 1400° C. and 1600° C. Thus, for composition C3, the material from which these ashes is obtained can be modified as follows:

- firstly the $SiO_2$ and CaO concentrations in the initial composition of the treated material are balanced,
- the liquidus temperature of the ashes is reduced still further by adding fluxing agents, i.e. $K_2O$ and/or $Na_2O$ and/or $P_2O_5$ and/or MgO and/or $Fe_2O_3$.

The composition of the C2 ashes can also be optimised by reducing the liquidus temperature of these ashes, by adding a fluxing agent, for example $Fe_2O_3$ or MgO (depending on the compositions of ashes, MgO can be fluxing in character if it is added in small quantities).

The reactor's operating temperature can be modified, notably by altering the flow rate of oxygen (a reactant gas) at the inlet of the high-temperature chamber. Indeed, the direct consequence of increasing the flow of oxygen at the inlet of the chamber is to increase the temperature of the gases in the chamber, since the fuel is then oxidised to a greater degree.

In order to optimise the reactor's chemical efficiency it is therefore possible to seek to minimise the reactor's operating temperature by minimising the oxygen flow rate, whilst keeping the reactor's operating temperature higher than the liquidus temperature of the ashes derived from the treated material, with, for example, a difference between these two temperatures of between approximately 30° C. and 100° C. An operating temperature enabling the coal of the biomass to be gasified completely should also be chosen. This temperature may, however, be reduced by reducing the size of the particles introduced into the reactor's inlet. This applies until the size is attained below which a stage of purely chemical operation is reached, and there is no longer any limitation of speed due to diffusion. Below this size the kinetics of gasification then depend solely on the temperature. It is, notably, possible that the material gasified in the thermal treatment process described here is pretreated biomass, for example in the form of small particles, a solid suspension in an organic liquid (i.e. a "slurry"), of char (biomass coal), according to techniques such as the fluidized bed technique, the slow pyrolysis technique, torrefaction, or again grinding.

The size of the particles of the treated material and the addition of fluxing agents are therefore two parameters which enable the chemical efficiency of the reactor to be optimised whilst minimising the requirement of oxygen for combustion.

The previously described method of thermal treatment of material applies when the reactor is operating in a steady state. However, it is also possible to optimise the reactor's start-up phase, i.e. the phase during which the solid ashes layer is formed against the reactor wall.

The cooling accomplished by the cooling circuit 14 enables the solid ashes layer to be formed with a thickness sufficient to afford thermal protection to the wall, and particularly the intermediate layer 16. The characteristic time for formation of the solid ashes layer 18 is inversely proportional to the flow rate of the reactor 1. For example, in the case of an industrial size reactor (i.e. one in which the flow rate is higher than or equal to approximately 50 tonnes/hour, the solid ashes layer 18 can be formed in approximately six hours, whereas for a small-size reactor (flow rate equal to approximately 50 kg/h), the solid ashes layer will be formed after approximately 5 days.

When the reactor starts, it is possible to accelerate the formation of the solid ashes layer (base deposition phase), whilst reducing energy losses during the base deposition phase by the following steps:

increasing the rate of ashes in the biomass, reducing the reactor's operating temperature during the start-up phase. This action has a direct effect on the thermal losses and the thickness of the solid ashes.

The invention claimed is:

1. A method of operating a material treatment reactor having a high-temperature chamber and a self-crucible wall of entrained flow type, the method comprising:

thermally treating a material in the reactor to create treated material and ashes derived from the treated material;

determining a liquidus temperature $T_{liq}$ of said ashes derived from the treated material, $T_{liq}$ of said ashes being the temperature above which all constituents of said ashes become liquid; and operating the reactor in steady state at an operating temperature of the reactor $T_{fonc}$ which satisfies: $T_{fonc}>T_{liq}$ modifying an initial composition of treated material through addition of inorganic compounds; followed by determining liquidus temperature $T_{liq2}$ of the ashes derived from the modified composition of the treated material; and operating the reactor in steady state at an operating temperature $T_{fonc}$ in the steady state which satisfies $T_{fonc}>T_{liq2}$.

2. The method according to claim 1, in which $T_{fonc}$ is such that 30° C.≤($T_{fonc}-T_{liq}$)≤100° C.

3. The method according to claim 1, in which the initial composition of the treated material is modified such that liquidus temperature $T_{liq2}$ of the ashes derived from the modified composition of the treated material is between approximately 1000° C. and 1800° C.

4. The method according to claim 1, in which the initial composition of the treated material is modified such that liquidus temperature $T_{liq2}$ of the ashes derived from the modified composition of the treated material is between approximately 1400° C. and 1600° C.

5. The method according to claim 4, in which the modification of the initial composition of the treated material such that the liquidus temperature $T_{liq2}$ of the ashes derived from the modified composition of the treated material is between approximately 1400° C. and 1600° C. includes adding inorganic compounds to the initial composition of treated material making $SiO_2$ and CaO concentrations in the modified composition of treated material roughly equal.

6. The method according to claim 1, in which the initial composition of the treated material is modified by adding MgO and/or $Fe_2O_3$ and/or $K_2O$ and/or $Na_2O$ and/or $P_2O_5$ and/or CaO and/or $SiO_2$, depending on desired liquidus temperature $T_{liq2}$ of the ashes derived from the modified composition of the treated material.

7. The method according to claim 1, in which a thickness of a layer of solid ashes of the self-crucible wall of the reactor is less than or equal to approximately 5 cm and/or is roughly constant during operation of the reactor at its operating temperature $T_{fonc}$.

8. The method according to claim 1, in which a thickness of a layer of solid ashes of the self-crucible wall of the reactor is between approximately 1 cm and 2 cm and/or is roughly constant during operation of the reactor at its operating temperature $T_{fonc}$.

9. The method according to claim 1, in which a composition of ashes formed on the wall of the reactor is analyzed at least once in a course of a thermal treatment process.

10. The method according to claim 1, in which the treated material is biomass.

11. The method according to claim 1, in which the liquidus temperature of the ashes derived from the treated material is determined by a thermodynamic computation software.

12. The method according to claim 1, in which $T_{fonc}$ is such that 30° C.≤($T_{fonc}-T_{liq2}$)≤100° C.

* * * * *